US011350720B2

(12) United States Patent
Siu

(10) Patent No.: US 11,350,720 B2
(45) Date of Patent: Jun. 7, 2022

(54) CURLING IRON WITH ION EMITTER

(71) Applicant: CONAIR CORPORATION, Stamford, CT (US)

(72) Inventor: Kwan Shing Benny Siu, Tseung Kwan O (HK)

(73) Assignee: Conair LLC, Stamford, CT (US)

( * ) Notice: Subject to any disclaimer, the term of this patent is extended or adjusted under 35 U.S.C. 154(b) by 0 days.

(21) Appl. No.: 16/996,051

(22) Filed: Aug. 18, 2020

(65) Prior Publication Data

US 2022/0053901 A1 Feb. 24, 2022

(51) Int. Cl.
*A45D 1/04* (2006.01)
*A45D 1/00* (2006.01)

(52) U.S. Cl.
CPC ..... *A45D 1/04* (2013.01); *A45D 1/00* (2013.01); *A45D 2200/202* (2013.01)

(58) Field of Classification Search
CPC ..... A45D 1/04; A45D 2200/202; A45D 1/00; A45D 1/02; A45D 1/06; A45D 1/08; A45D 1/10; A45D 1/14; A45D 1/16; A45D 1/20; A45D 2/00; A45D 2/02; A45D 2/04; A45D 2/06
USPC ..... 132/222, 223, 224, 225, 269, 272; 401/137–139
See application file for complete search history.

(56) References Cited

U.S. PATENT DOCUMENTS 4,075,458 A * 2/1978 Moyer ..... A45D 1/04 116/216
D314,444 S 2/1991 Ho
D331,296 S 11/1992 Smal
D547,903 S 7/2007 Rizzuto, Jr.
D559,446 S 1/2008 Leung
7,644,511 B2 1/2010 Ishikawa et al.
D698,488 S 1/2014 Byun
D736,464 S 8/2015 Fernandes Da Costa
D872,360 S 1/2020 Abramov et al.
D914,286 S 3/2021 Swackhamer
D921,290 S 6/2021 Yang
2005/0198855 A1* 9/2005 Cafaro ..... A45D 20/10 34/97
2005/0224091 A1* 10/2005 Cafaro ..... A45D 1/04 132/228
2007/0085036 A1* 4/2007 Santhouse ..... A45D 2/00 250/492.21
2011/0203606 A1 8/2011 Recchion et al.
2013/0240498 A1 9/2013 Tang
(Continued)

OTHER PUBLICATIONS

International Search Report dated Sep. 29, 2021 from corresponding International Patent Application No. PCT/US2021/045354, 2 pages.
(Continued)

*Primary Examiner* — David J Walczak
(74) *Attorney, Agent, or Firm* — Ohlandt, Greeley, Ruggiero & Perle, L.L.P.

(57) ABSTRACT

A curling iron includes a first member and a clamp segment connected to the first member configured for relative movement between a spaced apart position for receiving hair between the clamp segment and the first member and a closed position to impart a curling effect. A heating assembly is connected to the first member and/or clamp segment. The curling iron has at least one ion emitter for generating ions upon activation of the curling iron.

11 Claims, 5 Drawing Sheets

(56) References Cited

U.S. PATENT DOCUMENTS

| | | | |
|---|---|---|---|
| 2013/0306099 | A1 | 11/2013 | Lam et al. |
| 2014/0144458 | A1 | 5/2014 | Hein |

OTHER PUBLICATIONS

Written Opinion dated Sep. 29, 2021 from corresponding International Patent Application No. PCT/US2021/045354, 4 pages.
Non-Final Office Action dated Oct. 12, 2021 from corresponding U.S. Appl. No. 29/746,848, 10 pages.
AmoVee 2 in 1 Flat Iron Curling Iron, AmoVee, Reviewed on Jan. 18, 2019 on amazon.com, retrieved on Oct. 8, 2021, retrieved from the Internet URL: https://www.amazon.com/CUrling-Straightener-Titanium-Voltage-included/dp/B07GQWPKYY.

* cited by examiner

CURLING IRON WITH ION EMITTER

BACKGROUND OF THE DISCLOSURE

1. Field of the Disclosure

The present disclosure relates to devices for styling hair. The present disclosure further relates to a curling iron with ion emitter.

2. Description of the Related Art

Delivering ions or ionically charged molecules to a person's hair provides benefits including the removal of undesirable static charge that naturally occurs in hair. For example, U.S. Pat. No. 7,644,511 filed Jun. 27, 2007 ("Ishikawa") provides a hair dryer that discharges ions. In particular, Ishikawa provides a hair dryer that has a main body housing having an inlet port and a discharge port, an air flow path with the air flow path extending from the inlet port to the discharge port and a bypass flow path with the bypass flow path branching off from the air flow path and leading to an ion emission port. Further, Ishikawa requires an auxiliary air inlet associated with the ion emission port. This structure results in the auxiliary air inlet and the ion emission port being in communication with the hair dryer's main inlet and outlet.

SUMMARY OF THE DISCLOSURE

A curling iron that emits ions is provided.

A curling iron is also provided that includes a first member and a clamp segment connected to the first member configured for relative movement between a spaced apart position for receiving hair between the clamp segment and the first member and a closed position to impart a curling effect. A heating assembly is connected to the first member and/or clamp segment. The curling iron has at least one ion emitter for generating ions upon activation of the curling iron.

The first member and the clamp segment can be connected to a handle, and the at least one ion emitter can be in a housing that is connected to the handle. The housing can have an air inlet and an air outlet. The housing can have an airflow generator that draws air into the air inlet and expels air through the air outlet. The airflow generator can be a fan in the housing. The ion emitter can have a positive ion emitter and a negative ion emitter.

The ion emitter can be a first ion emitter that includes a positive ion emitter and a negative ion emitter and a second ion emitter that includes a positive ion emitter and a negative ion emitter. The first ion emitter can be in a first housing that is connected to the handle and the second ion emitter can be in a second housing that is connected to the handle, and each of the first housing and the second housing can be an air inlet and an air outlet. An airflow generator can draw air into the air inlet and expel air through the air outlet generating an airflow including positive and negative ions out of the housing. A first airflow generator can draw air into the air inlet and expel air through the air outlet of the first housing and a second airflow generator can draw air into the air inlet and expel air through the air outlet of the second housing. The clamp segment can be connected to a lever that selectively moves the clamp segment between the spaced apart position and the closed position. The first member and the handle can be configured for relative movement between an extended position and a folded position.

The above and other objects, features, and advantages of the present disclosure will be apparent and understood by those skilled in the art from the following detailed description, drawings, and accompanying claims. As shown throughout the drawings, like reference numerals designate like or corresponding parts.

BRIEF DESCRIPTION OF THE DRAWINGS

The present disclosure will be more completely understood in consideration of the following detailed description in connection with the accompanying drawings, in which.

DETAILED DESCRIPTION OF THE DISCLOSURE

Figure 1:
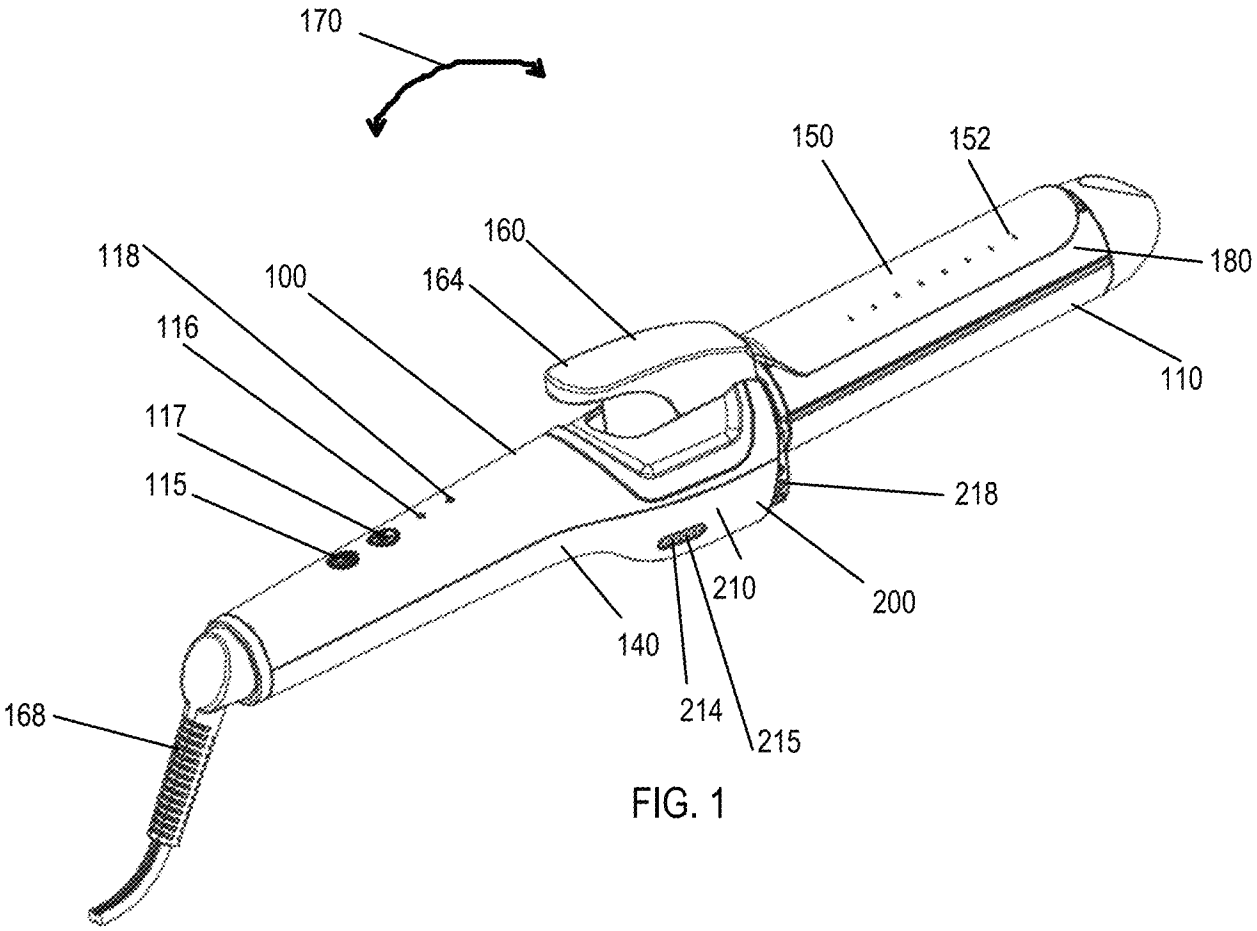
FIG. 1 is a top, rear perspective view of a curling iron having an ion emitter of the present disclosure.
Figure 2:
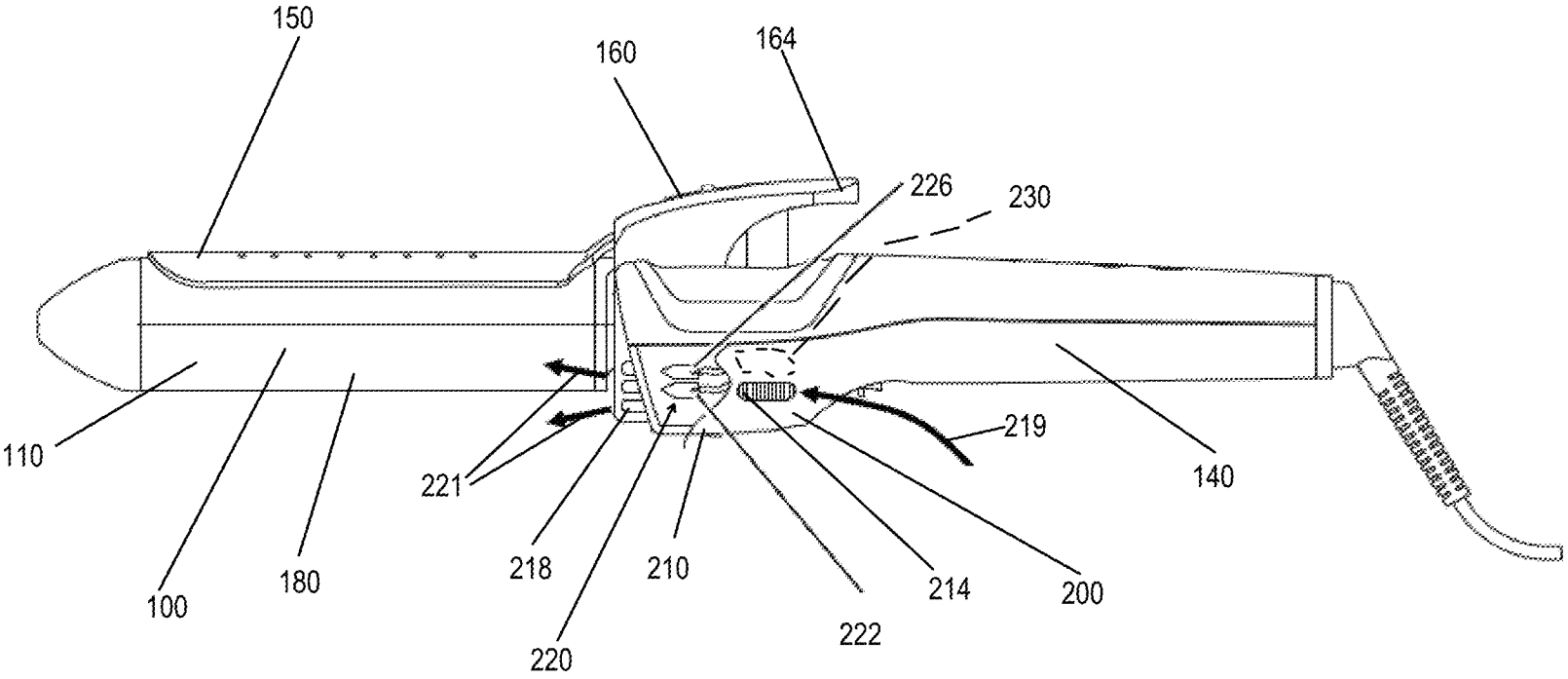
FIG. 2 is a side view of the curling iron of FIG. 1 having a portion of a housing removed.

Referring to FIGS. 1 and 2, there is provided a curling iron generally represented by reference numeral 100 having two ion emitter assemblies 200. Alternatively, curling iron 100 has only one ion emitter assembly 200 or more than two ion emitter assemblies 200. Curling iron 100 emits ions while functioning as a curling iron to style and curl hair.

Referring to FIG. 1, curling iron 100 has a handle 140 that is shaped to be griped by a user. Handle 140 is made of an insulative material. Handle 140 is connected to a housing 210 of each of ion emitter assemblies 200. Handle 140 and housing 210 are shown as being formed by one piece. However, housing 210 can be formed separately, and, then, connected to handle 140. Housing 210 has an air inlet 214 and an air outlet 218. Air inlet 214 is through a side of housing 210 and has openings 215 to allow air therethrough. The openings of air inlet 214 are sized to prevent fingers passing through the openings of air inlet 214. Air outlet 218 is through a front of housing 210 and has openings to allow air therethrough. The openings of air outlet 218 are sized to prevent fingers passing through the openings of air outlet 218.

Figure 4:
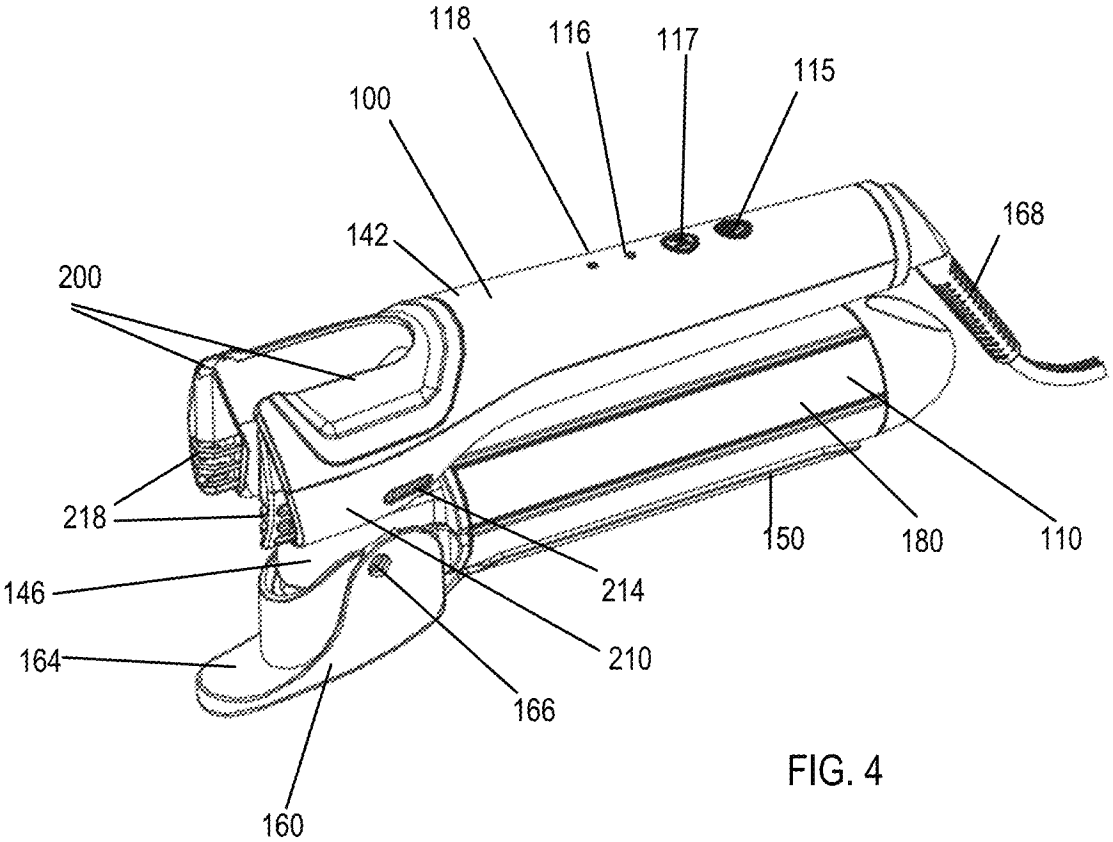
FIG. 4 is a top, front perspective view of the curling iron of FIG. 1 in a folded position.

Curling iron 100 has a clamp segment 150. Clamp segment 150 is shaped to mate with a first member 110 that is connected to handle 140. Clamp segment 150 has one or more holes, preferably two or more holes 152. Clamp segment 150 is connected to a lever 160. Lever 160 is connected to handle 140 by a hinge 166 that is shown in FIG. 4 so that lever 160 selectively rotates about the hinge in directions as shown by arrows 170 toward and away from handle 140 when a force is applied to a user engageable portion 164 of lever 160. Lever 160 is connected to a biasing mechanism, for example, a spring, that biases lever 160 to a position as shown in FIG. 1. Clamp segment 150 is made of conductive materials. Lever 160 is made of insulative materials.

Referring again to FIG. 1, handle 140 has a power button 115 and an ion button 117. Power button 115 is selectively depressed to turn curling iron 100 on and off. Ion button 117 selectively activates or deactivates generation of ions by ion generator assemblies 200. Handle 140 has a power indicator light 116 that is illuminated only when curling iron 100 is on and an ion indicator light 118 that provides an indication of whether ions are generated by ion generator assemblies 200, for example, by illuminating only when ions are being generated by ion generator assembly 200. Power indicator light 116 and ion indicator light 118 can be LED lights. Handle 140 is connected to a power cord 168 that supplies power. Power cord 168 can supply power to a heater assembly 180 of curling iron 100. Heater assembly 180 conducts heat to one or more of clamp segment 150 and first member 110 when power button 115 has been depressed turning on curling iron 100.

Referring to FIG. 2, each ion emitter assembly 200 has an ion emitter 220 inside housing 210. Ion emitter 220 has a negative ion emitter 222 and a positive ion emitter 226. Accordingly, there is one pair of positive ion emitter 226 and negative ion emitter 222. Both positive ion emitter 226 and negative ion emitter 222 are located inside of air outlet 218. The openings of air inlet 214 and the openings of air outlet 218 allow air to pass through. Since auxiliary air will be drawn in circulation for positive ion emitter 226 and negative ion emitter 222, this will bring extra positive and negative ions that are emitted out of housing 210. This, in other words, helps to increase a total amount of positive and negative ions during use of curling iron 100. Airflow can pass through the openings of air inlet 214 and the openings of air outlet 218 during use without an airflow generator. Alternatively, the airflow can be generated by an airflow generator 230 that draws air into air inlet 214 and expels air through air outlet 218, for example, a fan in housing 210.

Figure 3:
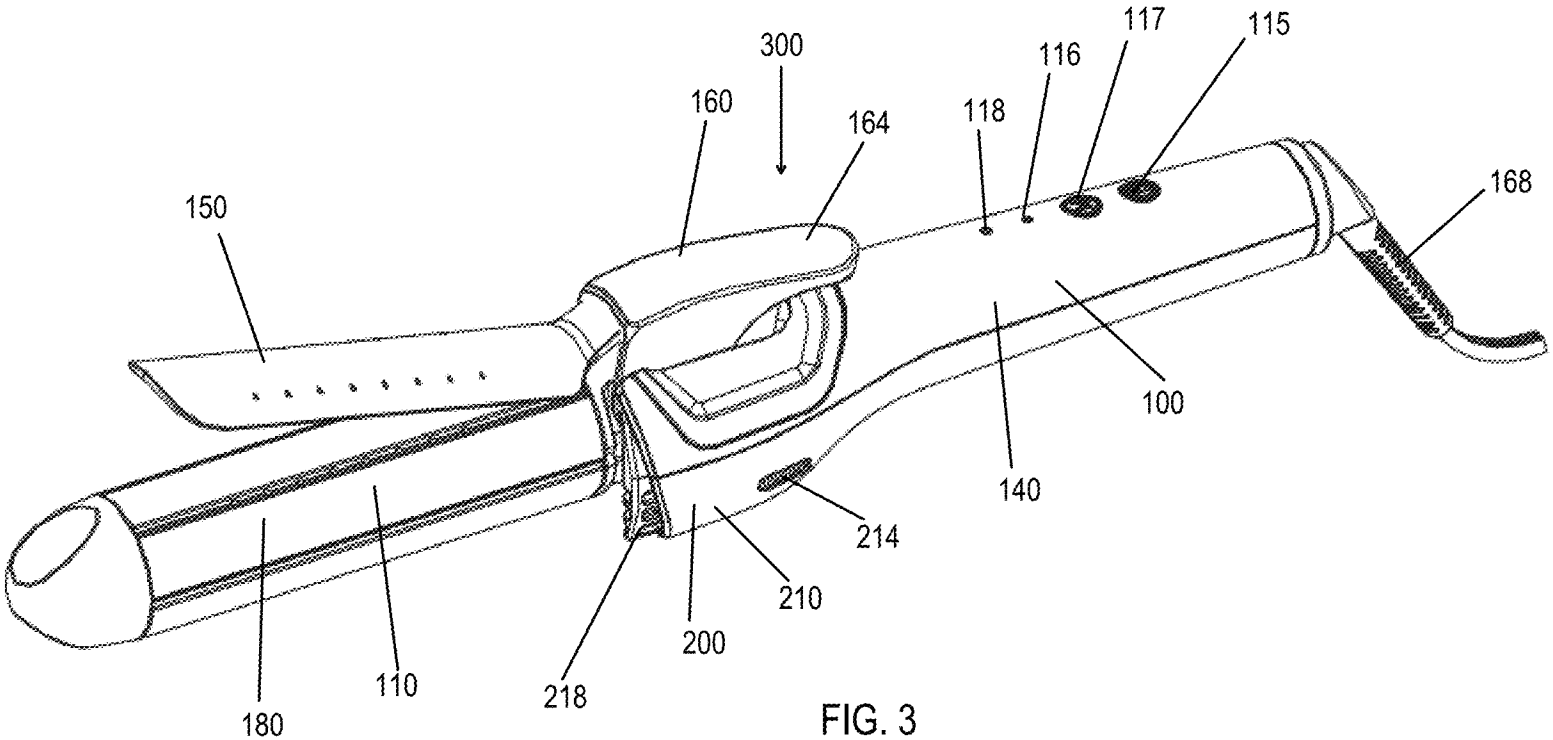
FIG. 3 is a top, front perspective view of the curling iron of FIG. 1 in an open position.

Referring to FIG. 3, in use, a user connects power cord 168 to a power source, for example, a plug in an electrical outlet. The user depresses power button 115 to turn curling iron 100 on supplying power to heater assembly 180 to heat one or more of clamp segment 150 and first member 110. The user can determine if ion generator assemblies 200 are generating ions by ion indicator light 118. If ion indicator light 118 is illuminated, then ion generator assemblies 200 are generating ions. If ion indicator light 118 is not illuminated, then ion generator assemblies 200 are not generating ions and the user can depress ion button 117 supplying power to ion generator assemblies 200 to generate ions. When user depresses ion button 117, power can also be supplied to airflow generator 230 to draw air into air inlet 214, as shown by arrows 219 in FIG. 2, and expels air through air outlet 218 as shown by arrows 221 in FIG. 2, creating an airflow to move ions out of air outlet 218. If the user does not desire ions to be emitted during use of curling iron 100, then the user can depress ion button 117 to stop supply of power to ion generator assemblies 200, or ion generator assemblies 200 and airflow generator 230, to stop generating ions. When the user has completed use of curling iron 100, the user depresses power button 115 to turn curling iron off that stops supply of power to all of ion emitter assemblies 200, heater assembly 180, airflow generator 230, and any combination thereof.

Still referring to FIG. 3, the user applies a force in a direction as shown by arrow 300 on engageable portion 164 to push lever 160 moving clamp segment 150 away from first member 110 from the closed position to the spaced apart position to insert the user's hair. The user releases the force applied to engageable portion 164 in the direction as shown by arrow 300 allowing the biasing mechanism to move clamp segment 150 closer to first member 110 clamping the user's hair between clamp segment 150 and first member 110. The heat applied by heater assembly 180 to one or more of clamp segment 150 and first member 110 while the user's hair is clamped between clamp segment 150 and first member 110 imparts a curling effect to the user's hair.

If ion emitter assemblies 200 are activated, then each ion emitter assembly 200 draws auxiliary air in circulation for positive ion emitter 226 and negative ion emitter 222 to bring extra positive and negative ions that are emitted out of housing 210 into contact with the user's hair while the user's hair is clamped between clamp segment 150 and first member 110. The positive and negative ions can remove undesirable static charge that naturally occurs in hair. The user applies a force in the direction as shown by arrow 300 on engageable portion 164 to push lever 160 to the open position to release the user's hair. The user can then insert the same or a different section of the user's hair between clamp segment 150 and first member 110 to impart the curling effect.

Figure 6:
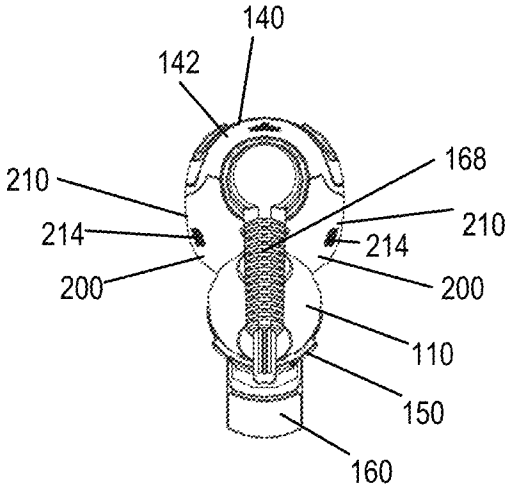
FIG. 6 is a rear view of the curling iron of FIG. 1 in the folded position.
Figure 5:
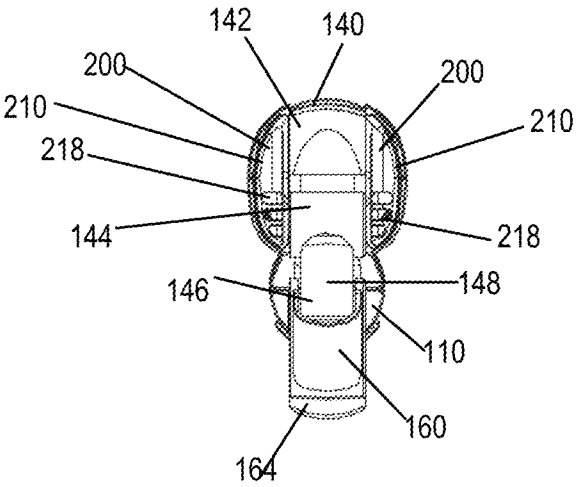
FIG. 5 is a front view of the curling iron of FIG. 1 in the folded position.

Referring to FIGS. 4-6, handle 140 is foldable. Handle 140 has a first section 142 and a second section 146. First section 142 is connected to second section 146 so that first section 142 and second section 146 are rotatable relative to one another.

Referring to FIG. 5, first section 142 has an outer connector 144 and second section 146 has an inner connector 148. Outer connector 144 and inner connector 148 are on a side of handle 140 opposite to power button 115. Outer connector 144 is connected on opposite sides of inner connector 148 to form a hinge connection. For example, inner connector 148 has an opening and a pin passes through the opening in inner connector 148 and outer connector 144 connects to opposite sides of the pin. Second section 146 rotates first member 110 relative to first section 142 between an extended position, as shown in FIG. 1, and a folded position as shown in FIG. 4. Accordingly, curling iron 100 in the folded position is compact for storage or transportation.

Curling iron 100 including at least one ion emitter assembly 200 in housing 210 that has air inlet 214 and air outlet 218 that are not in communication with a hair dryer's main inlet and outlet overcome the disadvantages associated therewith. Further, curling iron 100 that has at least one ion emitter assembly 200 provides all the benefits of discharging positive and negative ions while curling the user's hair.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the disclosure will include all aspects falling within the scope of a fair reading of appended claims.

The invention claimed is:

1. A curling iron comprising:

a first member and a clamp segment connected to the first member configured for relative movement between a spaced apart position for receiving hair between the clamp segment and the first member and a closed position to impart a curling effect, the first member and the clamp segment are connected to a handle;

a heating assembly connected to the first member and/or the clamp segment; and at least one ion emitter connected to the handle for generating ions upon activation of the curling iron, wherein the at least one ion emitter is in a housing that is connected to the handle, wherein the housing has an air inlet and an air outlet, and wherein the air outlet is positioned on the handle.

2. The hair styling apparatus of claim 1, wherein the housing has an airflow generator that draws air into the air inlet and expels air through the air outlet.

3. The hair styling apparatus of claim 2, wherein the airflow generator is a fan in the housing.

4. The hair styling apparatus of claim 1, wherein the at least one ion emitter has a positive ion emitter and a negative ion emitter.

5. The hair styling apparatus of claim 1, wherein the at least one ion emitter is a first ion emitter and a second ion emitter.

6. The hair styling apparatus of claim 1, wherein the clamp segment is connected to a lever that selectively moves the clamp segment between the spaced apart position and the closed position.

7. The hair styling apparatus of claim 1, wherein the first member and the handle are configured for relative movement between an extended position and a folded position.

8. A curling iron comprising:

a first member;

a clamp segment connected to the first member configured for relative movement between a spaced apart position for receiving hair between the clamp segment and the first member and a closed position to impart a curling effect, the first member and the clamp segment are connected to a handle;

a heating assembly connected to the first member and/or the clamp segment; and a first ion emitter and a second ion emitter connected to the handle for generating ions upon activation of the curling iron, wherein the first ion emitter is in a first housing that is connected to the handle and the second ion emitter is in a second housing that is connected to the handle, and wherein each of the first housing and the second housing has an air inlet and an air outlet.

9. The hair styling apparatus of claim 8, further comprising an airflow generator that draws air into the air inlet and expels air through the air outlet generating an airflow including positive and negative ions out of the housing.

10. The hair styling apparatus of claim 8, further comprising a first airflow generator that draws air into the air inlet and expels air through the air outlet of the first housing.

11. The hair styling apparatus of claim 10, further comprising a second airflow generator that draws air into the air inlet and expels air through the air outlet of the second housing.

* * * * *